US006243544B1

(12) United States Patent
Tsuneeda

(10) Patent No.: US 6,243,544 B1
(45) Date of Patent: Jun. 5, 2001

(54) METHOD AND APPARATUS FOR FORMING IMAGE

(75) Inventor: Kenichi Tsuneeda, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/562,008

(22) Filed: May 2, 2000

(51) Int. Cl.[7] ..... G03G 15/16

(52) U.S. Cl. ..... 399/66; 399/101; 399/313; 399/314

(58) Field of Search ..... 399/66, 314, 310, 399/297, 127, 101, 313

(56) References Cited

U.S. PATENT DOCUMENTS 6,049,681 * 4/2000 Shiozawa et al. ..... 399/66 X

FOREIGN PATENT DOCUMENTS 8-190286 7/1996 (JP) .
10-186877 * 7/1998 (JP) .

* cited by examiner

*Primary Examiner*—Susan S. Y. Lee
(74) *Attorney, Agent, or Firm*—Foley & Lardner

(57) ABSTRACT

The first transfer bias (opposite polarity to that of toner) is applied to a transfer roller to transfer a correction pattern on a photosensitive drum to the transfer roller. A toner adhesion amount sensor detects the adhesion amount of residual transfer toner which is not transferred and remains on the photosensitive drum. The first transfer bias is changed based on the deviation between the detected adhesion amount of residual transfer toner and its reference value. The second transfer bias (same polarity as that of toner) is applied to the transfer roller to transfer the correction pattern on the transfer roller to the photosensitive drum. The toner adhesion amount sensor detects the adhesion amount of reverse transfer toner upon reversely transferring the correction pattern on the transfer roller to the photosensitive drum by the second transfer bias. The second transfer bias is changed based on the deviation between the detected adhesion amount of reverse transfer toner and its reference value. Even when variations between the components of a transfer device, environmental variations, and life variations exist, the amount of toner adhered on the photosensitive drum is directly detected, and a transfer bias corrected based on the deviation from a predetermined reference value is calculated. Thus, the first and second transfer biases can be optimized.

16 Claims, 12 Drawing Sheets

METHOD AND APPARATUS FOR FORMING IMAGE

BACKGROUND OF THE INVENTION

There are several methods for a transfer device used in an electrophotographic image forming apparatus. A widely known example among these methods is a transfer roller method using a conductive elastic member.

According to the transfer roller method, a transfer roller is disposed and rotated in press contact with a photosensitive member. A transfer bias of opposite polarity to that of toner on the photosensitive member is applied to the transfer roller to electrostatically attract the toner on a transfer medium.

As a method of controlling the transfer bias voltage applied to the transfer roller, Japanese Patent Laid-Open No. 4-335383 discloses a method of detecting the toner amount on a photosensitive member before transfer, and controlling the transfer bias in accordance with the detected toner amount such that if the toner amount is large, the transfer bias is decreased, and if the toner amount is small, the toner bias is increased.

However, this method does not detect the transfer efficiency during actual operation, and thus uses a table representing the relationship between the toner amount and the transfer bias that is prepared in advance by tests. Therefore, an optimal transfer bias cannot always be selected owing to environmental variations, changes in the resistance and thickness of the transfer medium in addition to the difference between the transfer roller used as a transfer means and the photosensitive drum. The method cannot satisfactorily prevent a transfer error and the like.

Japanese Patent Laid-Open No. 10-31375 discloses the following method. A toner image is transferred to a region at the end of a transfer roller where a transfer medium does not pass, and the density is detected and fed back to an image formation process control means to optimize image formation. Further, the reverse transfer bias is applied to the toner image adhering to the end of the transfer roller to reattach the toner image on a photosensitive drum, thereby cleaning the transfer roller.

However, the method disclosed in this reference suffers the following problems.

(1) Detecting toner adhering to the transfer roller is suitable for sensing variations in toner adhesion amount in developing operation under fixed transfer bias conditions. However, the toner adhesion amount after transfer is unknown, so the transfer efficiency cannot be detected.

Hence, an optimal transfer bias to be applied to the transfer roller cannot be obtained.

(2) The surface material (or the physical characteristics of the surface) is different between the image region and non-image region of the transfer roller. Optimal transfer bias conditions change depending on the surface material and surface characteristics. Thus, an optimal transfer bias actually necessary in the image region cannot be obtained.

When the transfer roller is used, the roller itself becomes dirty after repetitive printing operations. To solve this, a bias (cleaning bias) of opposite polarity to that of the transfer roller applied to the transfer roller in transferring an image to a transfer medium must be applied to the transfer roller when no printing is done, so as to reattach the toner on the photosensitive member. However, since the surface material of the transfer roller changes depending on the region, as described above, no optimal cleaning bias in the image region can be obtained.

As described above, it is difficult for the conventional methods to attain optimal transfer conditions for transferring a toner image from a photosensitive member to a transfer roller or transfer belt.

SUMMARY OF THE INVENTION

It is an object of the present invention to provide a method and apparatus for forming an image that can attain optimal transfer conditions in transferring a toner image from a photosensitive member to a transfer means, regardless of the characteristics of the transfer means, environmental variations, and life variations.

According to the present invention, there is provided an apparatus for forming an image, comprising a developing unit for forming a visible image on a photosensitive member with a developer mix, transfer means for transferring the visible image to a transfer medium, a developer mix adhesion amount sensor which faces the photosensitive member and detects an adhesion amount of developer mix adhered on the photosensitive member, transfer bias application means for applying, to the transfer means, a first transfer bias for transferring the visible image on the photosensitive member to the transfer means, and a second transfer bias for reversely transferring the visible image on the transfer means to the photosensitive member, and transfer bias change means for, when the visible image is transferred to the transfer means by the first transfer bias and an adhesion amount of residual transfer developer mix which is not transferred and is left on the photosensitive member is detected by the developer mix adhesion amount sensor, changing the first transfer bias using the detected adhesion amount of residual transfer developer mix, and when an adhesion amount of reverse transfer developer mix upon reversely transferring the visible image on the transfer means to the photosensitive member by the second transfer bias is detected by the developer mix adhesion amount sensor, changing the second transfer bias using the detected adhesion amount of reverse transfer developer mix.

The transfer bias change means can change the first transfer bias on the basis of a deviation between the adhesion amount of residual transfer developer mix detected by the developer mix adhesion amount sensor and a predetermined transfer reference value, and can change the second transfer bias on the basis of a deviation between the adhesion amount of reverse transfer developer mix detected by the developer mix adhesion amount sensor and a predetermined reverse transfer reference value.

The transfer bias change means can be given in advance a count for correcting the first transfer bias until a deviation between the adhesion amount of residual transfer developer mix detected by the developer mix adhesion amount sensor and a predetermined transfer reference value falls within a first allowable value range, and when the deviation does not fall within the first allowable value range even after the first transfer bias is corrected by the count, can change the first transfer bias to a final correction value, and the transfer bias change means can be given in advance a count for correcting the second transfer bias until a deviation between the adhesion amount of reverse transfer developer mix detected by the developer mix adhesion amount sensor and a predetermined reverse transfer reference value falls within a second allowable value range, and when the deviation does not fall within the second allowable value range even after the second transfer bias is corrected by the count, can change the second transfer bias to a final correction value.

Before the transfer bias change means changes the transfer bias, an adhesion amount of developer mix of the visible image formed on the photosensitive member may be detected by the developer mix adhesion amount sensor, and at least one of a charging voltage for charging the photosensitive member and a developing bias for developing the image on the photosensitive member with the developer mix may be set on the basis of a deviation between the detected value and a predetermined developing reference value.

The transfer means may include a transfer roller, and the developer mix adhesion amount sensor may include an optical sensor.

BRIEF DESCRIPTION OF THE DRAWINGS

In the accompanying drawings.

DESCRIPTION OF THE PREFERRED EMBODIMENTS

An embodiment of the present invention will be described below with reference to the accompanying drawings.

Figure 1:
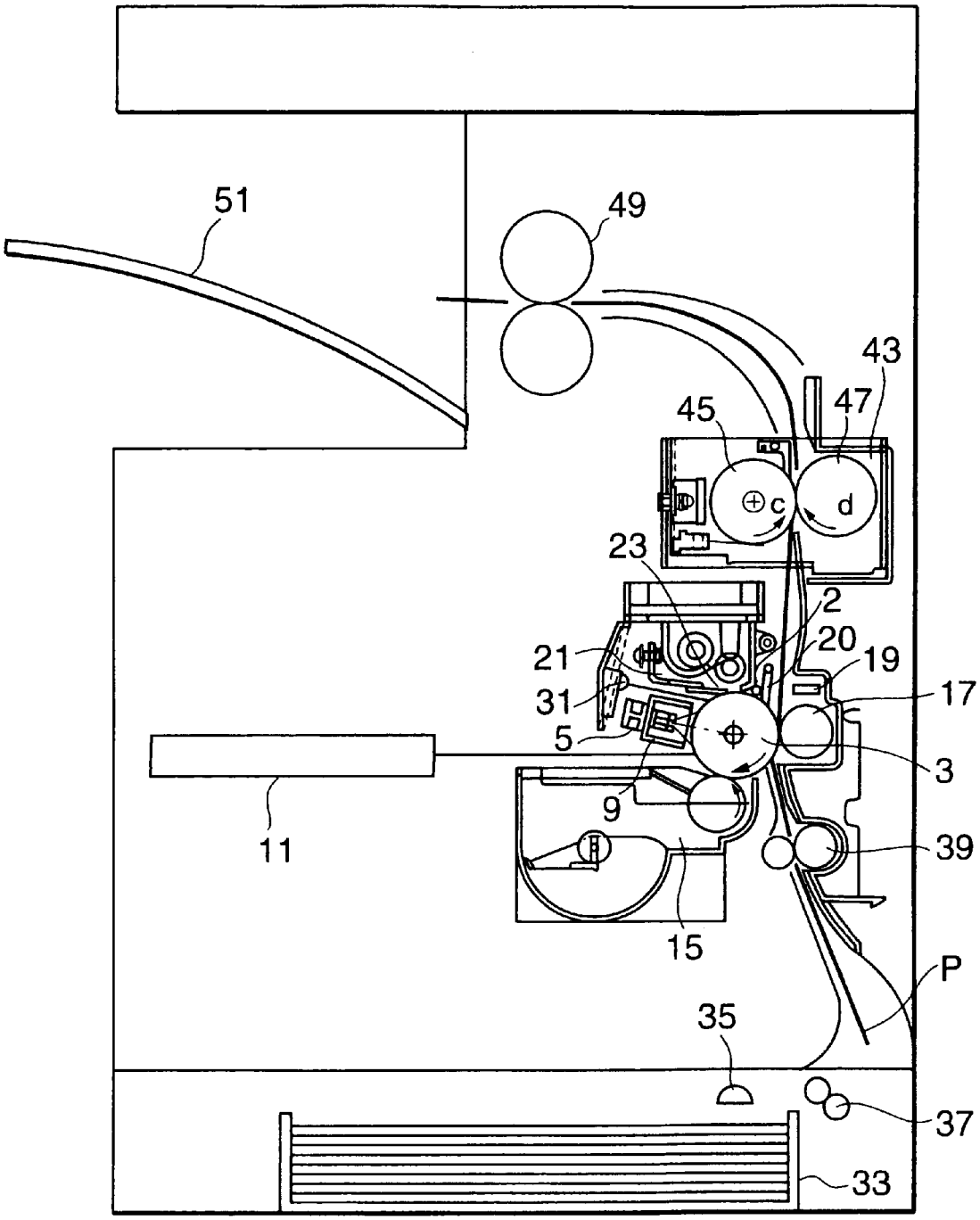
FIG. 1 is a longitudinal sectional view showing the whole schematic arrangement of an image forming apparatus according to an embodiment of the present invention.

FIG. 1 shows the whole schematic arrangement of an electrophotographic image forming apparatus. This image forming apparatus comprises a photosensitive drum 3 as an image carrier, and the photosensitive drum 3 is rotatable in a direction indicated by an arrow.

The photosensitive drum 3 is surrounded by a charger 5, exposure unit 9, developing unit 15, transfer roller 17, separation/charge removal needle 19, cleaner 21, and cleaning blade 23.

The charger 5 faces the photosensitive drum 3, and uniformly charges the photosensitive drum 3.

The exposure unit 9 is located above the photosensitive drum 3, and guides light emitted by a laser unit 11 serving as a light source to the surface of the photosensitive drum 3 in order to expose the charged photosensitive drum 3 in accordance with an original image and form an electrostatic latent image.

The developing unit 15 is arranged on the downstream side of the exposure unit 9, houses toner and a carrier (not shown) serving as a developer mix, and develops an electrostatic latent image formed by the exposure unit 9 with the toner.

The transfer roller 17 is arranged on the downstream side of the developing unit 15, and transfers a toner image formed by the developing unit 15 onto a transfer sheet P serving as an image forming medium.

The charger 5, exposure unit 9, and developing unit 15 are included in a means for forming an image with a developer mix.

The separation/charge removal needle 19 is adjacent to the transfer roller 17, and in transfer, separates the transfer sheet P electrostatically attached to the photosensitive drum 3.

A separation claw 20 is arranged on the downstream side of the separation/charge removal needle 19, and when the transfer sheet P is not fully separated from the photosensitive drum 3, mechanically separates the transfer sheet P. The separation claw 20 has an ON/OFF (contact/non-contact) mechanism so as to bring the separation claw 20 into contact with the photosensitive drum 3 when the transfer sheet P is fed from its leading end, and to move the separation claw 20 apart from the photosensitive drum 3 after the leading end of the transfer sheet P passes through the separation claw 20.

The cleaner 21 is arranged on the downstream side of the photosensitive drum 3, and removes toner left on the photosensitive drum 3. The cleaner 21 has the cleaning blade 23, and scrapes and recovers toner on the photosensitive drum 3 with the cleaning blade 23.

A toner adhesion amount sensor 2 is inserted between the cleaner 21 and the separation claw 20.

The toner adhesion amount sensor 2 is an optical sensing means including a light-emitting element such as an LED and a light-receiving element such as a phototransistor or photodiode.

A charge removal lamp 31 for removing charges from the photosensitive drum 3 is located on the downstream side of the cleaner 21.

A sheet feed cassette 33 for storing transfer sheets P is located below the photosensitive drum 3. The sheet feed cassette 33 is detachable from the main body of the image forming apparatus.

A pickup roller 35 for picking up the transfer sheet P from the sheet feed cassette 33 is attached to the main body of the image forming apparatus.

A pair of sheet feed rollers 37 for separating transfer sheets P one by one and feeding them are disposed near the pickup roller 35.

A pair of registration rollers 39 for feeding a conveyed transfer sheet P to the photosensitive drum 3 at a predetermined timing are arranged along the convey direction of the transfer sheet P on the upstream side of the transfer roller 17. The pair of registration rollers 39 convey the transfer sheet P while gripping it, and supply the sheet P to between the photosensitive drum 3 and the transfer roller 17.

The separation/charge removal needle 19, and a fixing unit 43 serving as a fixing means for fixing a toner image on the transfer sheet P are arranged along the convey direction of the transfer sheet P on the downstream side of the transfer roller 17.

The fixing unit 43 has a pair of heat and press rollers 45 and 47.

The heat and press rollers 45 and 47 respectively rotate in directions indicated by arrows c and d in FIG. 1, thereby fusing and fixing a toner image on the transfer sheet P.

A pair of discharge rollers 49 for discharging a transfer sheet P having a fixed toner image to outside the main body of the image forming apparatus, and a discharge tray 51 for receiving the discharged transfer sheet P are arranged along the convey direction of the transfer sheet P on the downstream side of the fixing unit 43.

The image forming process of the image forming apparatus having this arrangement according to embodiment will be described.

The operator turns on the main switch of the image forming apparatus. When the temperature of the heat roller reaches a fixable temperature, the apparatus changes to an image formable state.

If the operator turns on a print key via an operation panel (not shown) to instruct image formation, the photosensitive drum 3 starts rotating in the direction indicated by the arrow. Then, the charger 5, developing roller 15*a*, transfer roller 17, and charge removal lamp 31 start operation.

The charger 5 uniformly charges the surface of the rotating photosensitive drum 3 to about −600 V, and applies a developing bias (about −400 V) to the developing roller 15*a*.

The exposure unit 9 irradiates the charged photosensitive drum 3 with an optical signal of a laser beam to expose an image region on the photosensitive drum 3, thereby forming an electrostatic latent image.

The developing unit 15 applies toner charged to about -15 $\mu$c/g in advance to the electrostatic latent image to form a tone image.

Transfer sheets P are picked up from the sheet feed cassette 33 one by one. At this time, transfer sheets P are picked up one by one by rotation of the pickup roller 35 and the pair of sheet feed rollers 37 which rotate based on a sheet feed clutch ON signal. Each transfer sheet P is supplied to between the photosensitive drum 3 and the transfer roller 17 by the pair of registration rollers 39 which rotate based on a registration clutch ON signal.

A predetermined transfer bias is applied to the transfer roller 17 in accordance with the embodiment (to be described later). The back surface of the supplied sheet P is positively charged, and a toner image is transferred to the transfer sheet P.

The grounded separation/charge removal needle 19 separates from the photosensitive drum 3 the transfer sheet P attached to the photosensitive drum 3 in transfer.

The separated transfer sheet P is conveyed toward the fixing unit 43 by a convey belt 41. The fixing unit 43 heats and fuses the toner image on the transfer sheet P, and fixes the toner image on the sheet P.

The transfer sheet P is discharged onto the discharge tray 51 by rotation of the pair of discharge rollers 49.

After transfer, the cleaner 21 removes toner left on the photosensitive drum 3. The charge removal lamp 31 removes charges from the photosensitive drum 3.

After charge removal processing by the charge removal lamp 31, one cycle of the image forming process by the photosensitive drum 3 is complete. For the next image forming process, the charger 5 charges the photosensitive drum 3 again.

Figure 6:
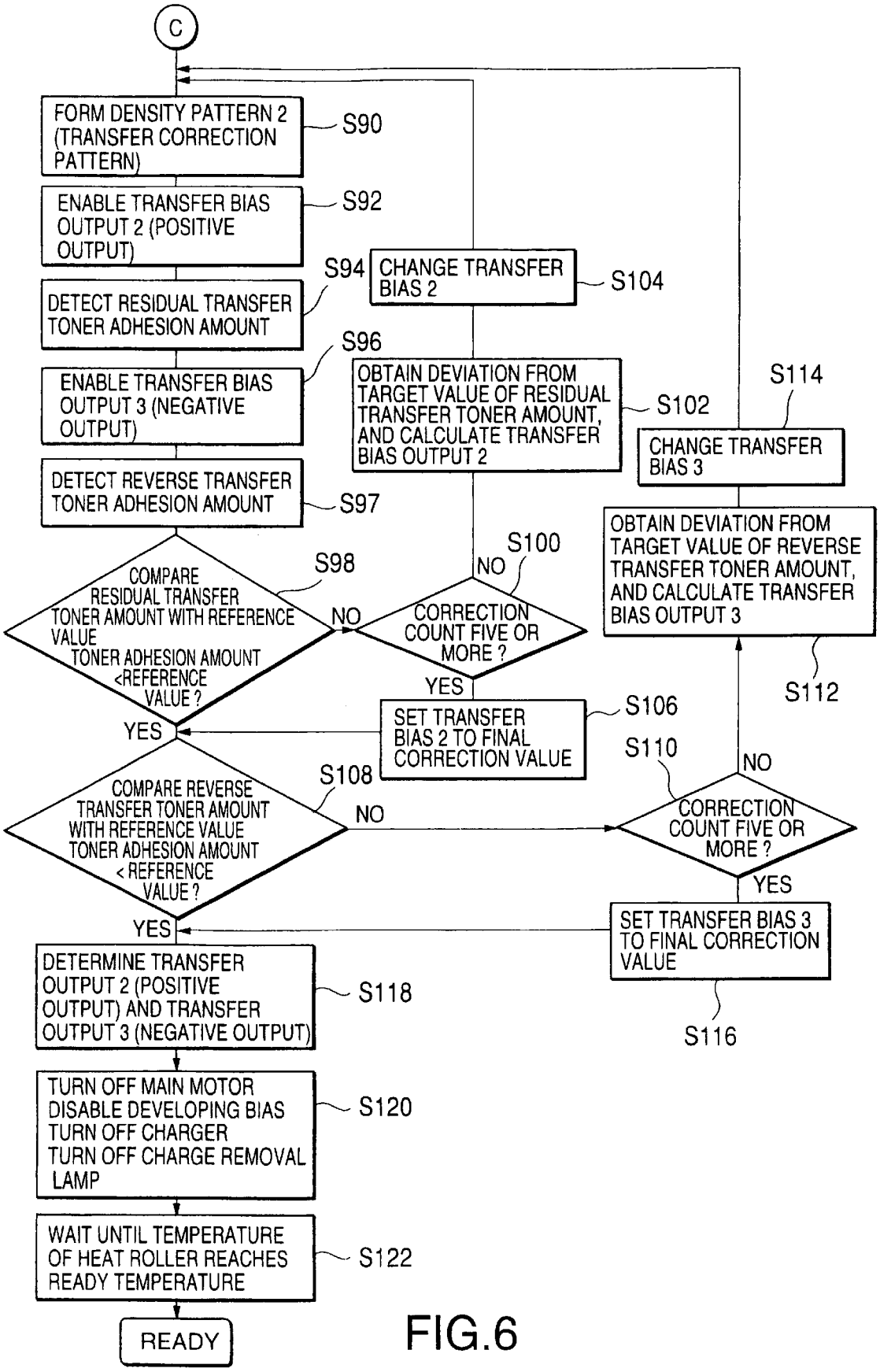
FIG. 6 is a flow chart showing a sequence of determining the transfer bias in the image forming apparatus.
Figure 7:
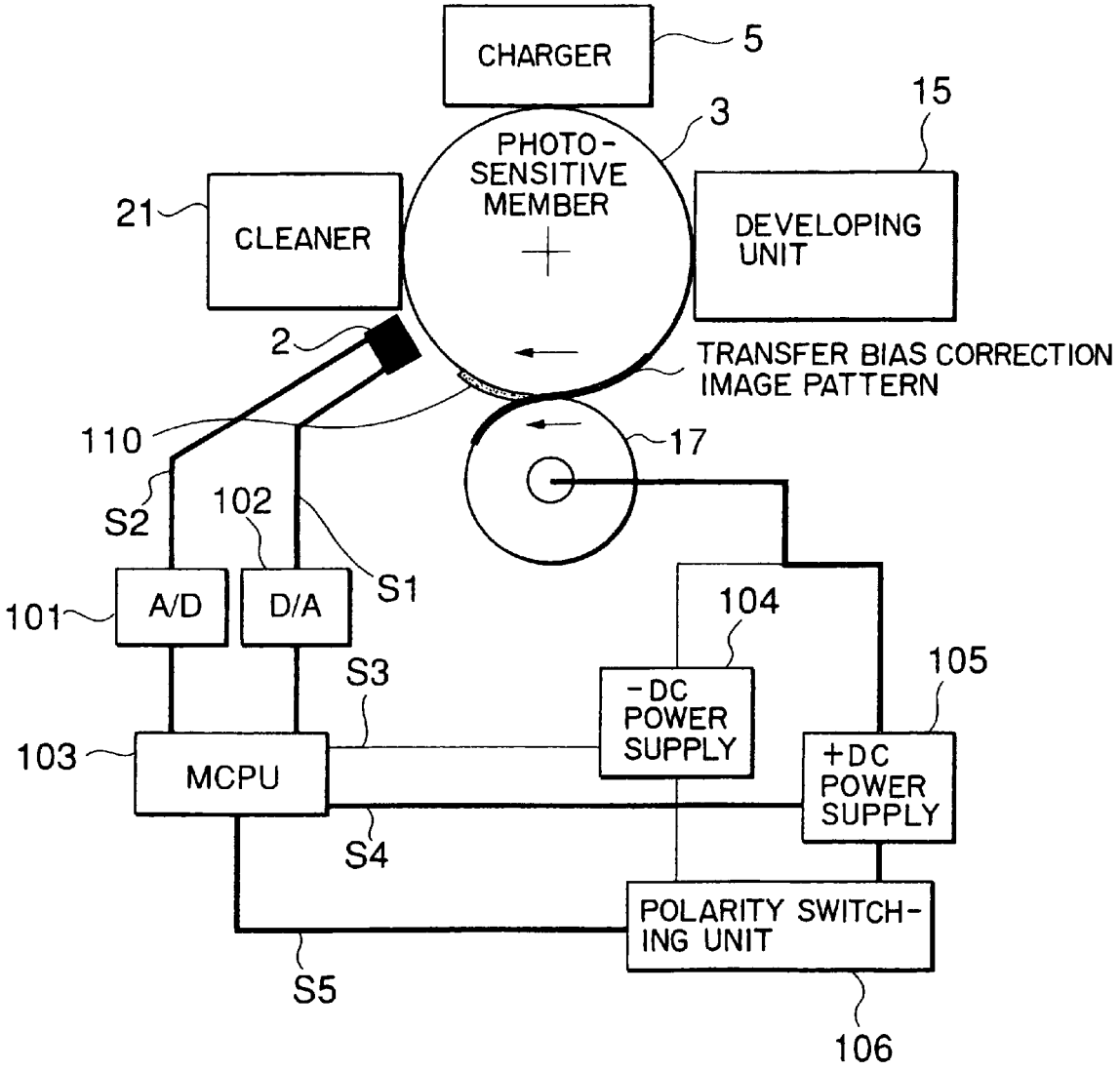
FIG. 7 is a block diagram showing signal transfer in determining the transfer bias in the image forming apparatus.
Figure 8:
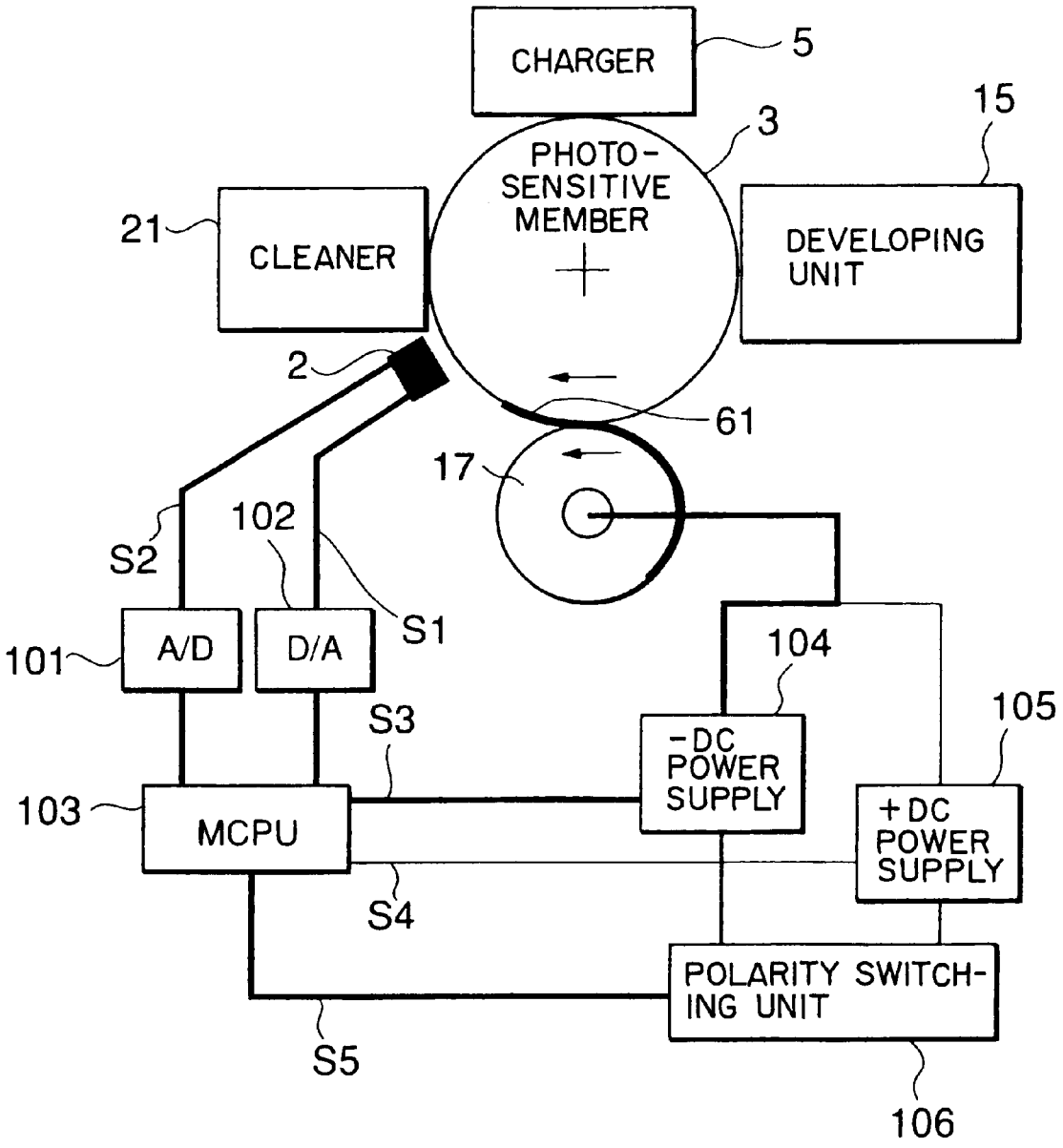
FIG. 8 is a block diagram showing signal transfer in determining the reverse transfer bias in the image forming apparatus.

The contents of a series of processes from ON operation of the power switch to setting of an image formable state to which this embodiment can be applied will be explained with reference to the flow charts in FIGS. 3 to 6 and the block diagrams in FIGS. 2, 7, and 8.

Figure 3:
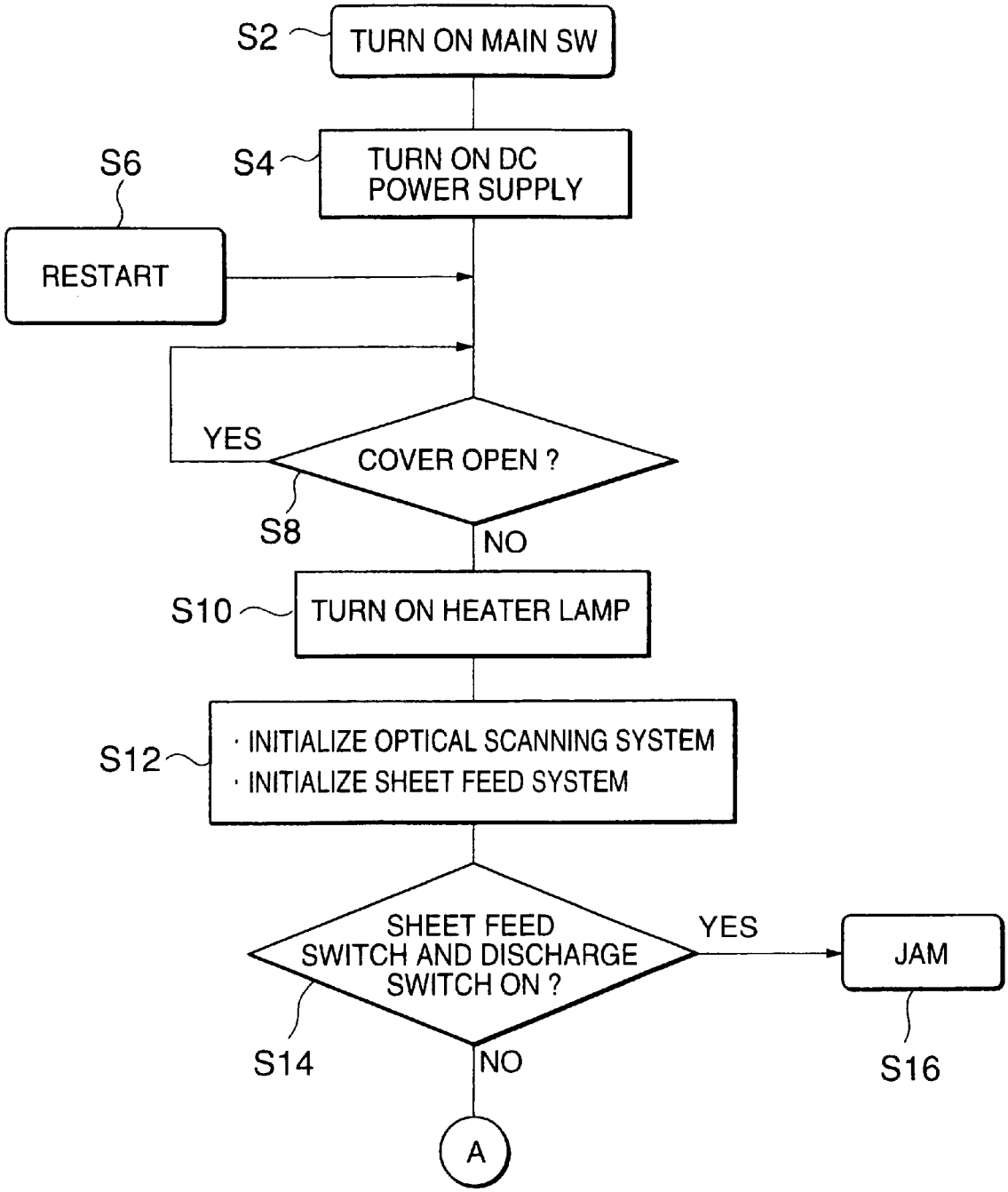
FIG. 3 is a flow chart showing a sequence upon power-on operation in the image forming apparatus.

In step S2 in the flow chart of FIG. 3, the power switch is turned on. In step S4, the DC power supply is turned on. Whether the cover of the main body of the image forming apparatus is open is checked in step S8, and if NO in step S8, the heater lamp is turned on in step S10.

In step S12, an optical system such as a scanner (not shown) for scanning an original, a sheet feed system, and the like are initialized.

Figure 4:
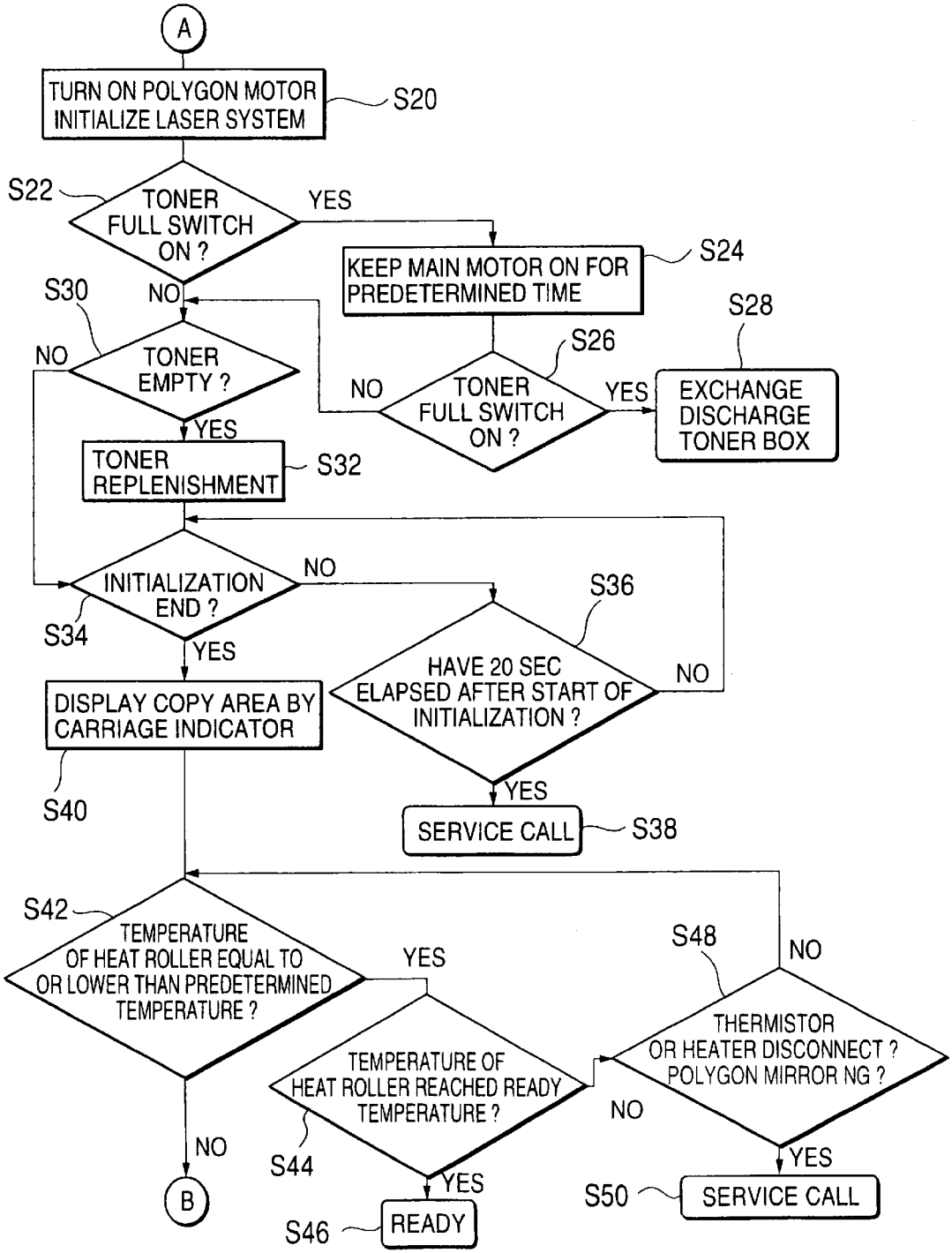
FIG. 4 is a flow chart showing an initialization sequence in the image forming apparatus.

The sheet feed switch and discharge switch are checked in step S14, and the flow shifts to step S20 and subsequent processes shown in FIG. 4.

In step S20, the polygon motor of the laser unit 11 is turned on to initialize an optical laser system. A toner supply means (not shown) for supplying toner to the developing unit 15 is checked.

In step S22, whether the toner full switch is ON is checked. If YES in step S22, the main motor is kept on for a predetermined time in step S24.

In step S26, whether the toner full switch is turned on is checked. If YES in step S26, the discharge toner box is exchanged in step S28; or if NO, the flow advances to step S30 to determine whether the toner is empty. If YES in step S30, toner replenishment is done in step S32. If NO in step S26 or after replenishment, the flow shifts to step S34.

In step S34, whether initialization ends is determined. If NO in step S34, whether 20 sec have elapsed after the start of initialization is determined in step S36. If initialization does not end even after 20 sec, the apparatus is determined to have failed, and a service call is made in step S38.

If YES in step S34, the carriage indicator displays a copy area in step S40.

The temperature of the heat roller is checked in step S42. If the temperature of the heat roller is equal to or lower than a predetermined temperature, whether the temperature of the heat roller has reached a ready temperature is checked in step S44. If YES in step S44, the apparatus is determined to be in an image formable state, and "ready" is displayed in step S46. If NO in step S44, whether the thermistor or heater has been disconnected or the polygon mirror has failed is checked in step S48. If YES in step S48, the apparatus must be repaired, and thus a service call is made in step S50.

Figure 5:
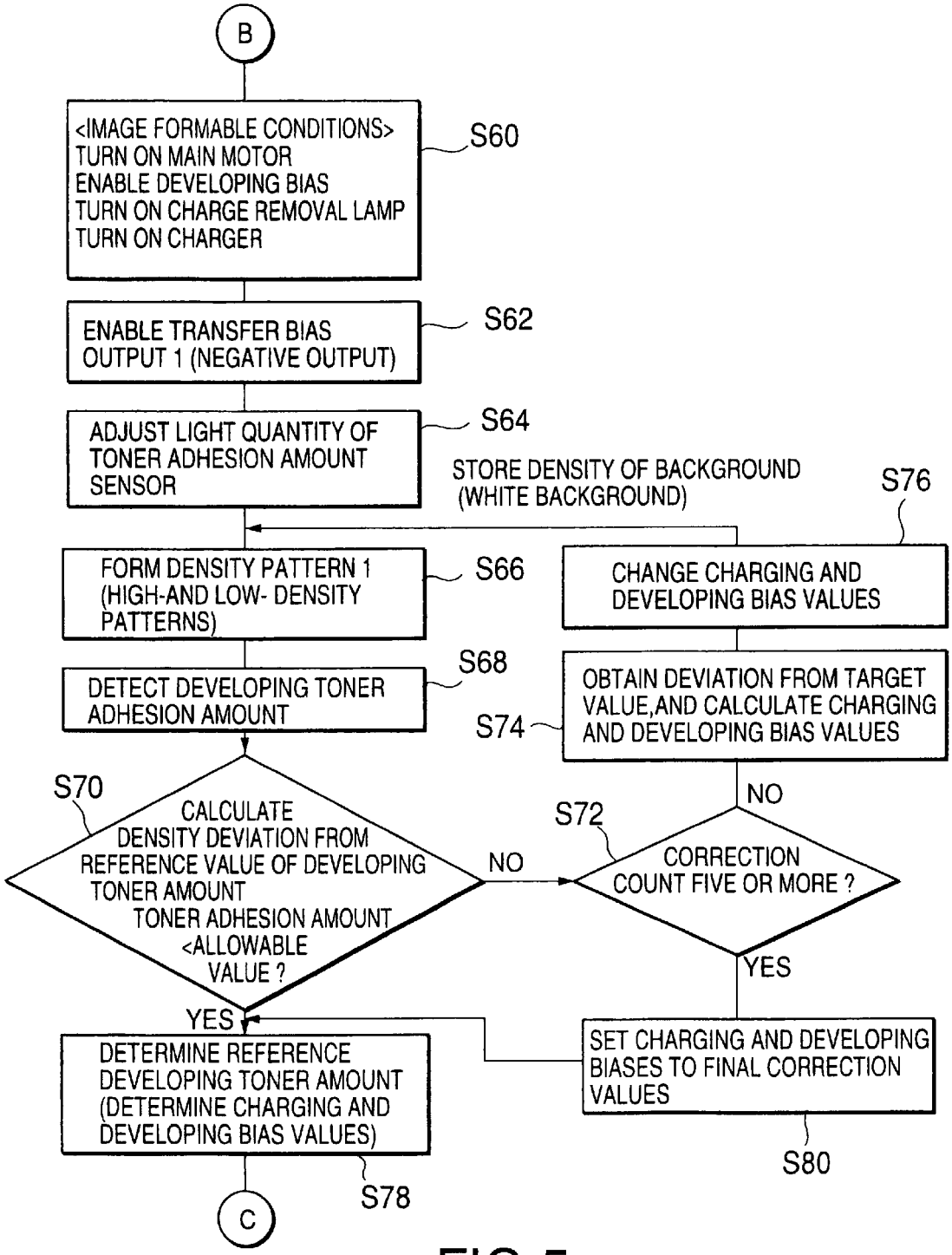
FIG. 5 is a flowchart showing a sequence of determining the developing bias in the image forming apparatus.

If NO in step S42, the use interval of the image forming apparatus is determined to be long, and the flow advances to the flow chart in FIG. 5.

In step S60, the main motor, developing bias, charge removal lamp, and charger are turned on to set an image formable state.

In step S62, transfer bias output 1 (negative output) is enabled. This output 1 is set to a predetermined voltage (e.g., about −200 V) which prevents even a small amount of toner on the surface of the photosensitive drum from being attracted by the transfer roller, and toner on the surface of the transfer roller from reattaching on the photosensitive drum.

In step S64, the toner adhesion amount sensor arranged on the upstream side of the cleaner detects the toner adhesion amount on a narrow background (blank base) on the surface of the photosensitive drum on the basis of the reflected light quantity. The detected amount is A/D-converted to store the detected value.

To obtain the developing toner adhesion amount, density pattern 1 is formed in step S66. This density pattern 1 is made up of predetermined high- and low-density regions which are alternately laid out at a pitch of 50 mm-square. This density pattern 1 is formed on the photosensitive drum.

In step S68, the toner adhesion amount sensor detects the developing toner adhesion amount.

The deviation between the detected developing toner adhesion amount and the toner adhesion amount of the background obtained in step S64 serves as a pure developing toner adhesion amount.

In step S70, the developing toner adhesion amount is compared with a predetermined developing toner reference value to calculate their density deviation.

If this density deviation is equal to or higher than an allowable value, the flow shifts to developing bias value change processing in steps S74 and S76. In step S72, the correction count is set to, e.g., five. If the count reaches the set correction count in step S80, the charging and developing biases are set to final correction values even when the density deviation is equal to or higher than the allowable value. This prevents any endless loop formed when correction is executed many times but the density deviation does not become lower than the allowable value in step S70.

In step S74, new charging and developing biases are calculated by a developing bias calculation means (not shown) based on the deviation between the developing toner reference value and the actual developing toner adhesion amount. In step S76, new charging and developing bias outputs are set at the output of the developing unit for outputting the developing bias.

Density pattern 1 is formed on the photosensitive drum again in step S66. The developing toner adhesion amount is detected in step S68, and compared with the allowable value in step S70.

This correction processing is repetitively performed within the correction count. If the deviation from the reference value becomes lower than the allowable value, or the count reaches the correction count, charging and developing bias output values at that time are defined as reference values, and the flow shifts to step S90 in FIG. 6.

Figure 2:
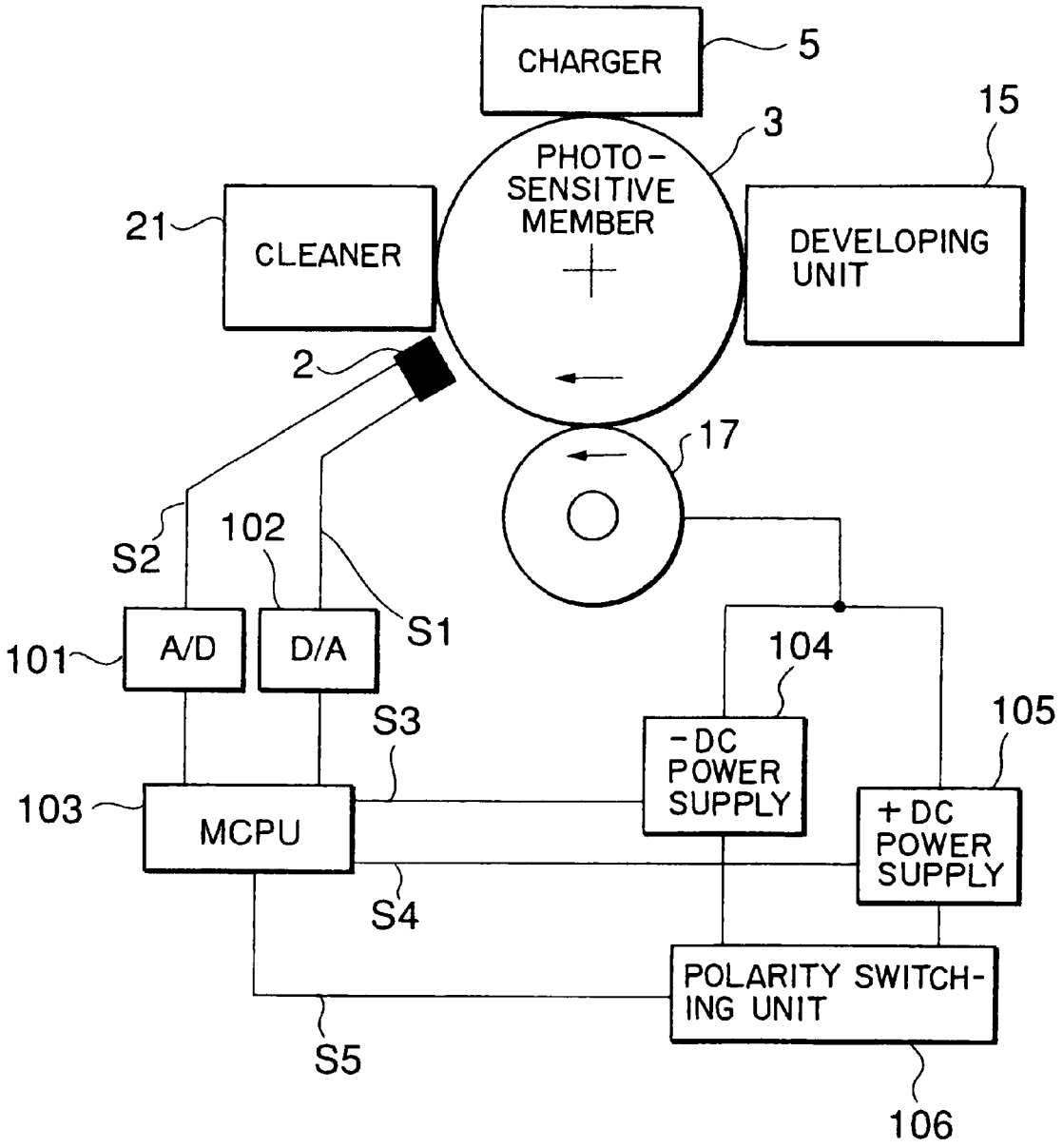
FIG. 2 is a block diagram showing the arrangement of a circuit for controlling the transfer bias in the image forming apparatus.

The arrangement of a means for correcting the transfer bias is shown in FIG. 2.

As described above, the photosensitive drum 3 is surrounded by the transfer roller 17, developing unit 15, charger 5, and cleaner 21.

Further, the image forming apparatus comprises the toner adhesion amount sensor 2 as a means for optimizing the transfer bias, and a main central processing unit (to be referred to as an MCPU hereinafter) 103, A/D converter 101, D/A converter 102, polarity switching unit 106, +DC power supply 105, and −DC power supply 104 as an arithmetic means for correcting the transfer bias.

The toner adhesion amount sensor 2 is an optical sensor for detecting the toner amount on the surface of the photosensitive drum 3.

The MCPU 103 generates a light source light quantity signal S1 in order to drive the sensor 2. The MCPU 103 receives a reflected light quantity signal S2 output from the sensor 2, and generates a polarity switching signal S5 to be supplied to the polarity switching unit 106 on the basis of the signal S2. Furthermore, the MCPU 103 generates a transfer bias control signal S4 and reverse transfer bias control signal S3 to be supplied to the +DC and −DC power supplies 105 and 104, respectively.

The +DC and −DC power supplies 105 and 104 respectively generate +DC and −DC power supply voltages having values based on the received control signals S4 and S3, and apply the voltages to the transfer roller 17.

The sequence of processing by the transfer bias correction means having this arrangement will be described with reference to the flow chart in FIG. 6.

In step S90, transfer bias correction density pattern 2 (constituted by alternately laying out, e.g., high- and low-density regions as 50-mm-square patches) is visualized by charging and developing biases determined by the sequence shown in the flow chart of FIG. 5.

In step S92, transfer bias output 2 is generated by the +DC power supply 105 and applied to the transfer roller 17. This transfer bias output 2 is positive, has a value determined before power-on operation, and is set to, e.g., about −1.2 kV.

By applying transfer bias output 2 to the transfer roller, density pattern 2 is electrostatically attracted by the transfer roller 17.

However, all the toner forming density pattern 2 on the photosensitive drum 3 cannot be transferred to the transfer roller 17. For this reason, residual transfer toner 110 remains on the surface of the photosensitive drum 3, as shown in FIG. 7.

The toner adhesion amount of residual transfer toner 110 is detected by the toner adhesion amount sensor 2 in step S94.

In step S96, negative transfer bias output 3 is applied to the transfer roller 17. More specifically, the MCPU 103 outputs the polarity switching signal S5 to the polarity switching unit 106 to switch the output from the +DC power supply 105 to the −DC power supply 104, and supplies the reverse transfer bias control signal S3 to the −DC power supply 104. The −DC power supply 104 outputs, e.g., a reverse transfer bias of about +400 V for one revolution of the transfer roller.

Then, toner on the surface of the transfer roller 17 which has received the reverse transfer bias electrostatically reattaches to the surface of the photosensitive drum 3. This toner is removed by the cleaner 21 to clean the surface of the photosensitive drum 3.

In step S98, the detected residual transfer toner adhesion amount is compared with the reference value of a predetermined residual transfer toner adhesion amount. In other words, the MCPU 103 compares the adhesion amount of residual transfer toner 110 detected by the toner adhesion amount sensor 2 with the reference value of the residual transfer toner adhesion amount. If the residual transfer toner adhesion amount exceeds the reference value, the MCPU 103 calculates a positive transfer bias based on the deviation between the target value of the residual transfer toner adhesion amount and the detected residual transfer toner adhesion amount, and changes the transfer bias output to the calculated value.

More specifically, the MCPU 103 calculates the deviation between the target value of the residual transfer toner adhesion amount and the detected residual transfer toner adhesion amount in step S102. Further, the MCPU 103 generates a transfer bias control signal S4 based on the deviation in step S102, and supplies the signal S4 to the +DC power supply 105, thereby changing the output of transfer bias 2 in step S104. The processes in steps S106 and S100 prevent formation of any endless loop, similar to steps S80 and S72 in FIG. 5.

In this case, the reference value of the residual transfer toner adhesion amount is set in advance, and the deviation between the reference value and a detected value is calculated to conduct a pass/fail check. Alternatively, an allowable transfer efficiency value given by equation (1):

Allowable Transfer Efficiency Value =(Developing Toner Adhesion Amount−Residual Transfer Toner Adhesion Amount)*100/Residual Transfer Toner Adhesion Amount (1)

may be calculated to change the transfer bias based on this value.

The processing of the loop including steps S98, S100, S102, S104, S90, S92, S94, and S96 is executed once to a plurality of numbers of times. When the residual transfer toner adhesion amount becomes equal to or lower than the reference value of the residual transfer toner amount, or the correction count reaches a predetermined count, the flow shifts to step S96.

The polarity of the transfer bias applied to the transfer roller 17 is switched from positive to negative by the MCPU 103 and polarity switching unit 106, and transfer bias output 3 (reverse bias) is applied to the transfer roller 17.

By applying transfer bias output 3, the toner on the transfer roller 17 reattaches to the photosensitive drum 3. In step S97, the toner adhesion amount sensor 2 detects the reverse transfer toner adhesion amount.

In step S108, the MCPU 103 compares the detected reverse transfer toner adhesion amount with the reference value of a predetermined reverse transfer toner adhesion amount. If the residual transfer toner adhesion amount exceeds the reference value, negative transfer bias output 3 is calculated in step S112 based on the deviation between the target value of the reverse transfer toner adhesion amount and the detected reverse transfer toner adhesion amount. In step S114, the value is changed to the output of transfer bias 3.

More specifically, the MCPU 103 calculates in step S112 the deviation between the target value of the reverse transfer toner adhesion amount and the detected reverse transfer toner adhesion amount. The MCPU 103 generates a reverse transfer bias control signal S3 based on the deviation in step S112, and supplies the signal S3 to the −DC power supply 104, thereby changing the output of transfer bias 3 in step S114. The processes in steps S116 and S110 prevent formation of any endless loop, similar to steps S106 and S100.

In this case, the reference value of the reverse transfer toner adhesion amount is set in advance, and the deviation between the reference value and a detected value is calculated to conduct a pass/fail check. Alternatively, an allowable reverse transfer efficiency value given by equation (2):

Allowable Reverse Transfer Efficiency Value=(Residual Developing Toner Adhesion Amount−Reverse Transfer Toner Adhesion Amount)*100/Residual Transfer Toner Adhesion Amount (2)

may be calculated to change the transfer bias based on this value.

The processing of the loop including steps S107, S110, S112, S114, S90, S92, S94, S96, and S98 is executed once to a plurality of numbers of times. When the detected reverse transfer toner adhesion amount becomes equal to or lower than the reference value of the reverse transfer toner amount, or the correction count reaches a predetermined count, the flow shifts to step S118.

In step S118, the transfer bias and reverse transfer bias are changed to the calculated transfer bias output 2 (positive) and reverse transfer bias output 3 (negative).

In step S120, the main motor, developing bias, charger, and charge removal lamp are sequentially turned off, and the flow waits in step S122 until the temperature of the heat roller reaches a ready temperature.

Operation after the start of printing will be described.

FIGS. 9 to 12 show the operation waveforms of respective signals until printing starts after the main motor rotates upon reception of a print signal in a ready state.

Figure 9:
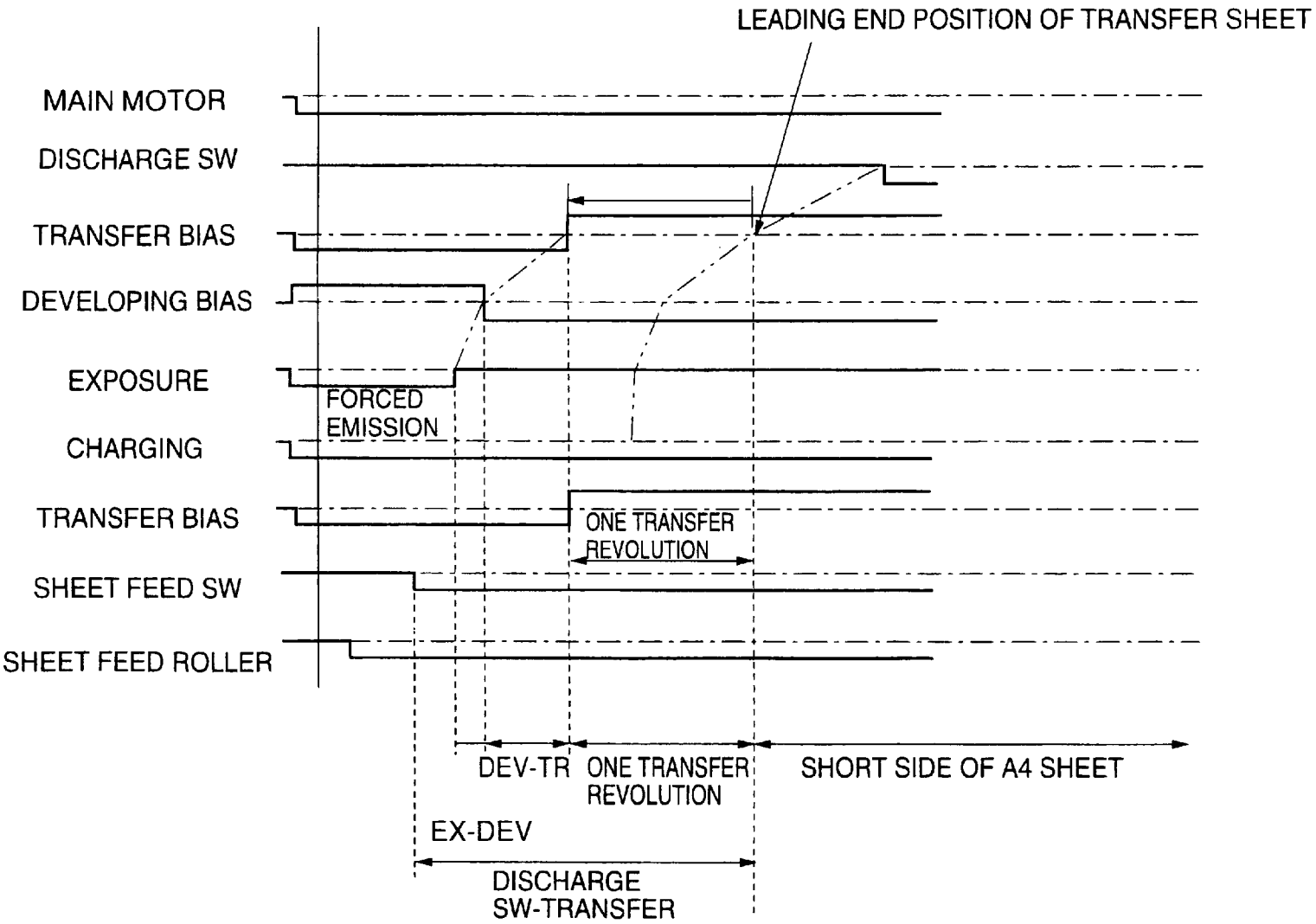
FIG. 9 is a timing chart showing the waveform of each signal during a printing start process in an image forming apparatus to which the present invention can be applied.

In FIG. 9, the main motor is turned on (in FIG. 9, the chain line represents the level in an OFF state). At the same time, the corrected transfer output 3 (negative output) is applied to the transfer roller 17, and toner on the surface of the transfer roller 17 reattaches to the surface of the photosensitive drum 3, which is cleaned by the cleaner 21.

Similarly, the charging and developing biases are enabled. As the developing bias, e.g., about 100 V is applied to minimize toner adhesion on the photosensitive drum 3 before image formation.

In synchronism with entrance of the leading end of an A4-size transfer sheet, the developing bias is switched to a normal negative bias before a time corresponding to the sum of one revolution of the transfer roller 17 and the developing-transfer phase difference elapses. The application voltage at this time is a bias determined in the above-mentioned developing toner adhesion amount correction step.

The bias is corrected by the same sequence after a developing-transfer moving time. The transfer bias is switched to transfer output 2 (positive output) to prepare for arrival of a sheet after one revolution of the transfer roller.

Figure 11:
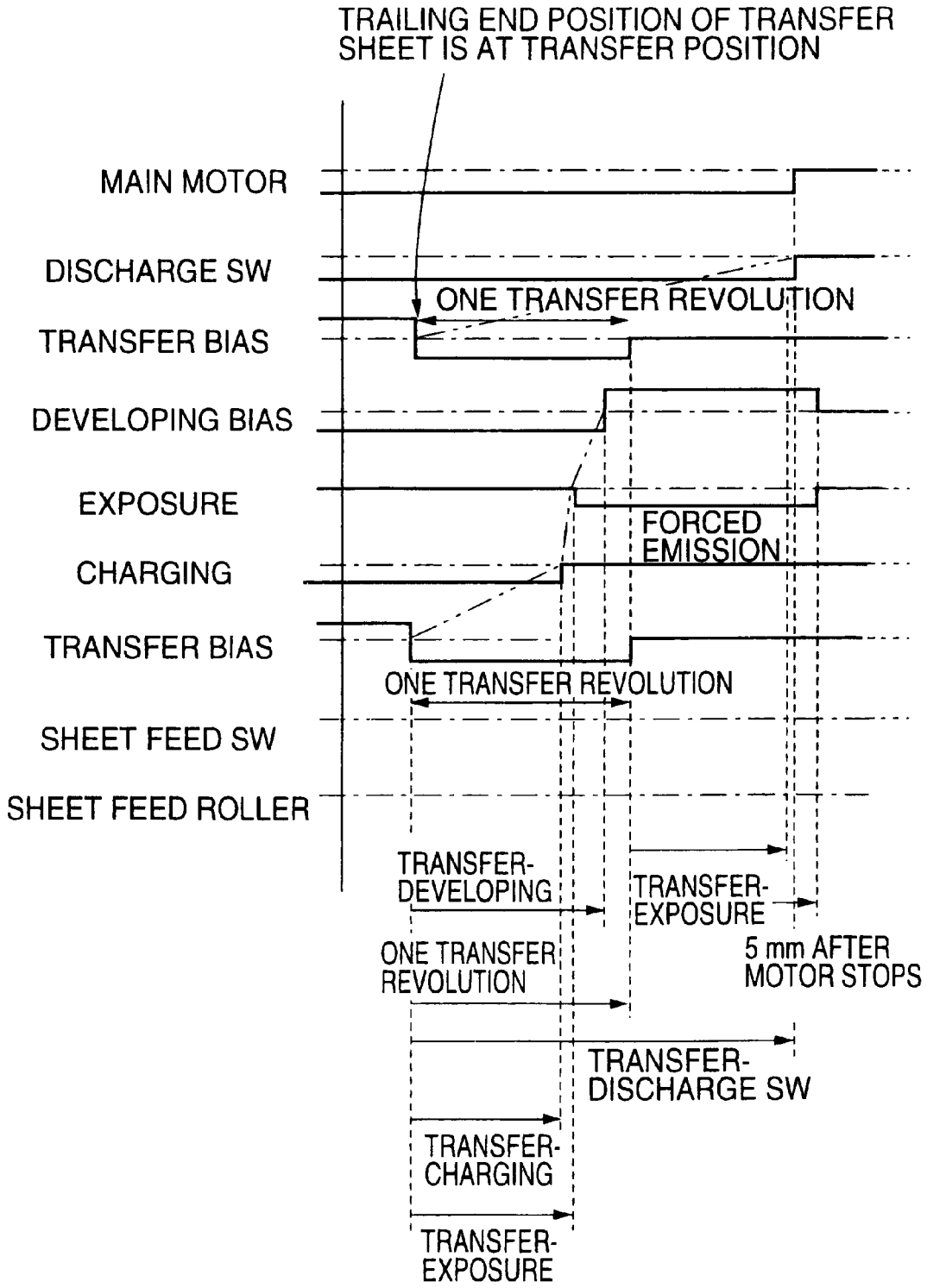
FIG. 11 is a timing chart showing the waveform of each signal during a printing end process in the image forming apparatus.

A transfer sheet reaches the transfer roller 17, and a toner image formed on the photosensitive drum is transferred to the transfer roller 17. At the end of printing, as shown in FIG. 11, transfer output 3 (negative output) is applied to the transfer roller 17 immediately after the trailing end of the transfer sheet passes through the transfer roller 17. Then, printing ends.

Figure 10:
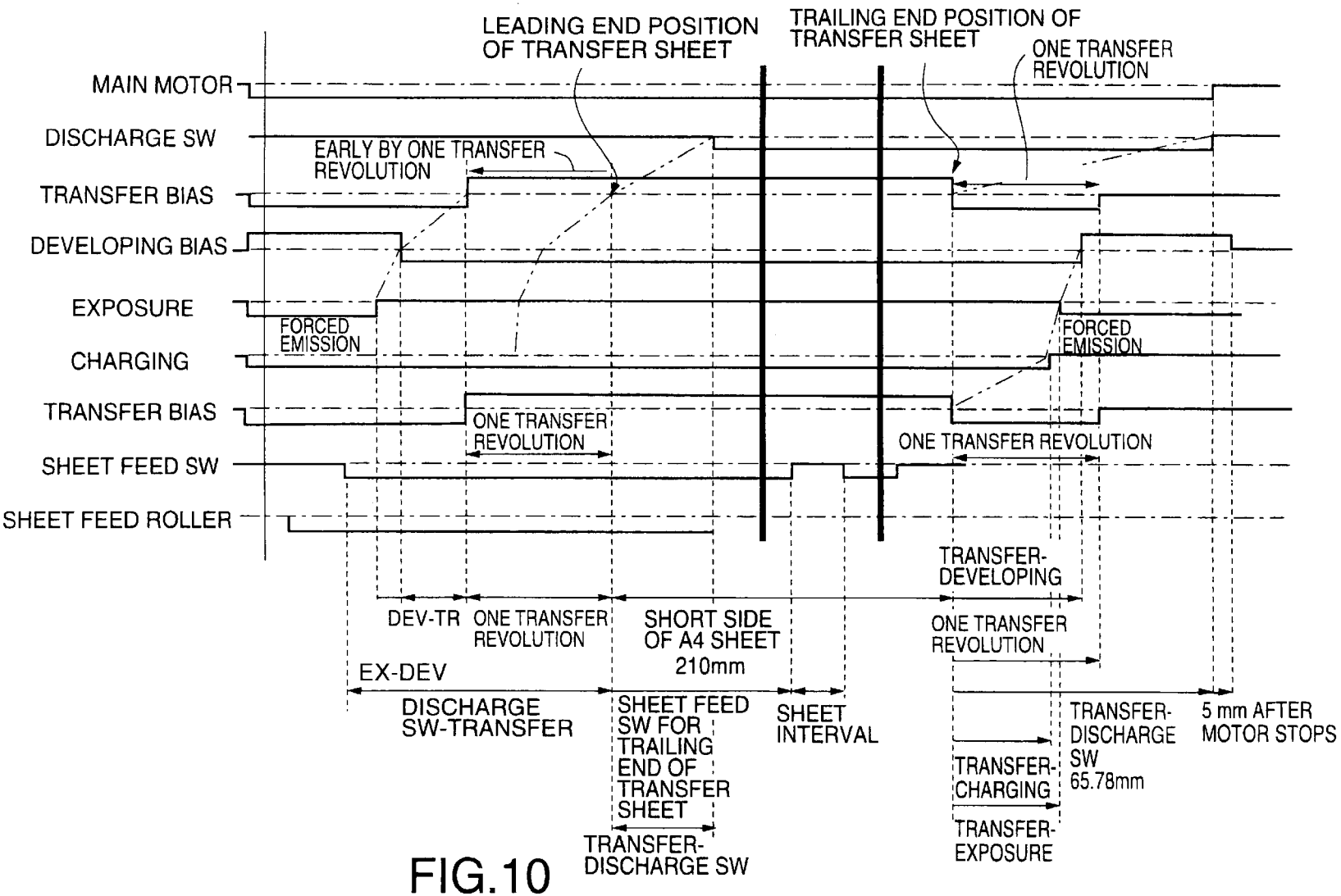
FIG. 10 is a timing chart showing the waveform of each signal during a normal printing process in the image forming apparatus.

As shown in FIG. 10, transfer output 2 (positive output) is applied to the transfer roller 17 at an interval between transfer sheets in continuous printing, similar to a case in which a sheet exists.

Figure 12:
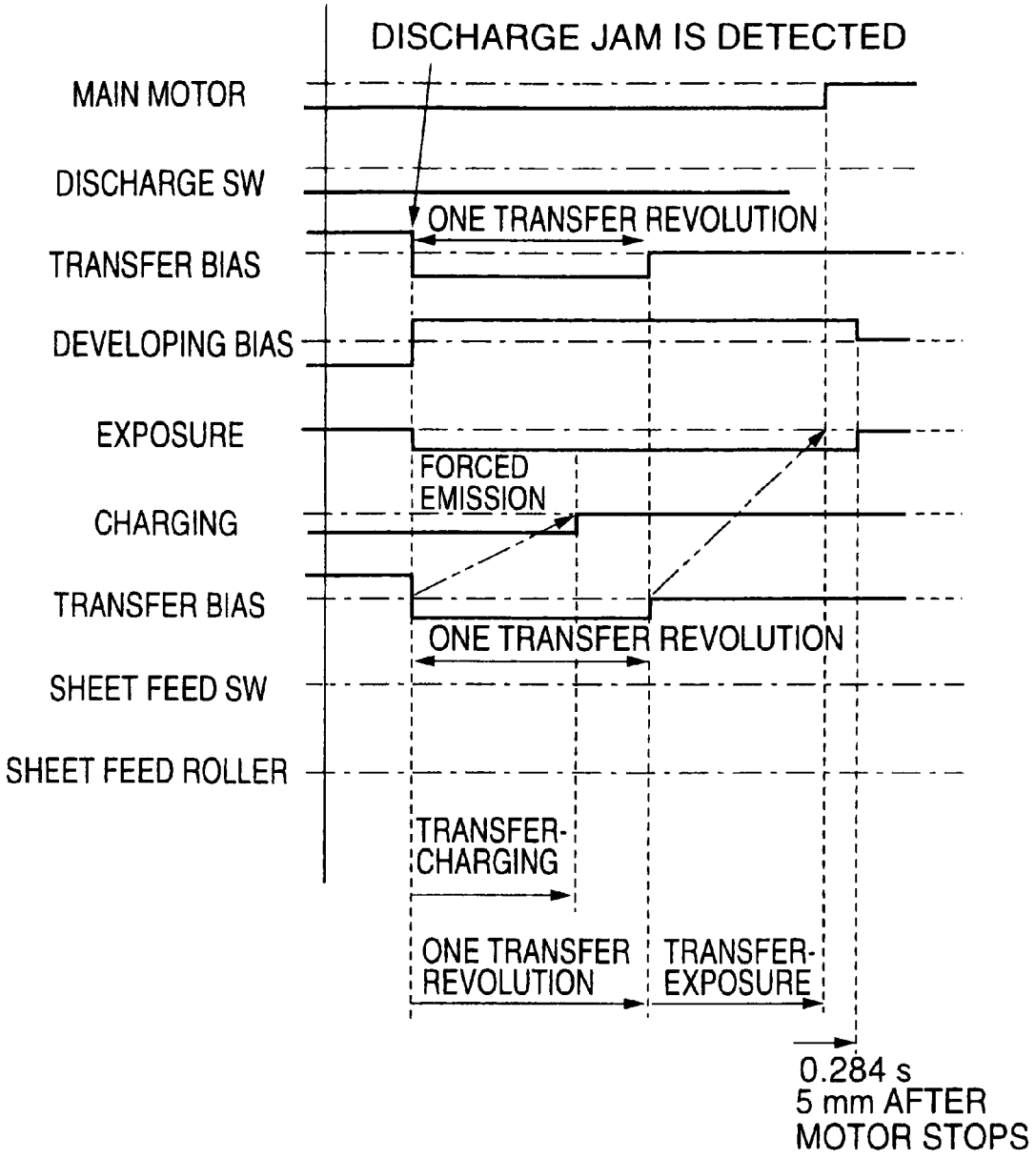
FIG. 12 is a timing chart showing the waveform of each signal upon occurrence of a jam in the image forming apparatus.

If a jam occurs, the polarity of the transfer bias is reversed from transfer output 2 (positive output) to transfer output 3 (negative output) simultaneously when the jam is detected, as shown in FIG. 12. Then, the toner adhered on the transfer roller reattaches to the photosensitive drum and cleaned. The transfer bias changes from transfer output 3 to "0", and the motor stops. The operator removes the transfer sheet causing the jam.

One embodiment of the present invention has been described. However, the present invention is not limited to this embodiment, and can be variously modified without departing from the spirit and scope of the invention.

For example, the above embodiment uses the transfer roller as a transfer means. However, even when a transfer belt is used in place of the transfer roller, the present invention can be similarly applied to correction of the transfer bias applied to the transfer belt.

The above embodiment performs transfer output correction processing after correction of the developing toner adhesion amount in order to correct the transfer bias at higher precision. However, even when the transfer bias is corrected without correcting the charging and developing biases, the objective effects of the present invention can be achieved.

The above embodiment does not optimize the reverse transfer bias for reattaching to the photosensitive drum the toner adhered to the transfer roller in order to clean the transfer roller. Alternatively, after the developing toner adhesion amount on the photosensitive drum is corrected before the start of actual printing, a toner image may be transferred to a transfer sheet, the developing toner adhesion amount on the photosensitive drum may be detected, and the transfer efficiency may be calculated to correct the reverse transfer bias. This enables output correction in accordance with the properties of a transfer sheet in use.

This method is effective when a special purpose sheet or archival sheet (moist sheet) is used as a transfer sheet having unique properties.

As has been described above, the method and apparatus for forming an image according to the present invention directly detect the amount of toner adhered on the photosensitive drum and calculate thetransfer bias corrected based on the deviation from a predetermined reference value even when variations between the components of the transfer means, environmental variations, and life variations exist. As a result, an optimal transfer bias can be set.

This prevents a transfer error caused by improper setting of the transfer bias value, and a noise image such as loss of solid areas resulting from the transfer error. High-quality images can be formed over a long period.

What is claimed is:

1. An apparatus for forming an image, comprising:

a developing unit for forming a visible image on a photosensitive member with a developer mix;

transfer means for transferring the visible image to a transfer medium;

a developer mix adhesion amount sensor which faces the photosensitive member and detects an adhesion amount of developer mix adhered on the photosensitive member;

transfer bias application means for applying, to said transfer means, a first transfer bias for transferring the visible image on the photosensitive member to said transfer means, and a second transfer bias for reversely transferring the visible image on said transfer means to the photosensitive member; and transfer bias change means for, when the visible image is transferred to said transfer means by the first transfer bias and an adhesion amount of residual transfer developer mixwhich is not transferred and is left on the photosensitive member is detected by said developer mix adhesion amount sensor, changing the first transfer bias using the detected adhesion amount of residual transfer developer mix, and when an adhesion amount of reverse transfer developer mix upon reversely transferring the visible image on said transfer means to the photosensitive member by the second transfer bias is detected by said developer mix adhesion amount sensor, changing the second transfer bias using the detected adhesion amount of reverse transfer developer mix.

2. An apparatus according to claim 1, wherein said transfer bias change means changes the first transfer bias on the basis of a deviation between the adhesion amount of residual transfer developer mix detected by said developer mix adhesion amount sensor and a predetermined transfer reference value, and changes the second transfer bias on the basis of a deviation between the adhesion amount of reverse transfer developer mix detected by said developer mix adhesion amount sensor and a predetermined reverse transfer reference value.

3. An apparatus according to claim 1, wherein said transfer bias change means is given in advance a count for correcting the first transfer bias until a deviation between the adhesion amount of residual transfer developer mix detected by said developer mix adhesion amount sensor and a predetermined transfer reference value falls within a first allowable value range, and when the deviation does not fall within the first allowable value range even after the first transfer bias is corrected by the count, changes the first transfer bias to a final correction value, and said transfer bias change means is given in advance a count for correcting the second transfer bias until a deviation between the adhesion amount of reverse transfer developer mix detected by said developer mix adhesion amount sensor and a predetermined reverse transfer reference value falls within a second allowable value range, and when the deviation does not fall within the second allowable value range even after the second transfer bias is corrected by the count, changes the second transfer bias to a final correction value.

4. An apparatus according to claim 1, wherein before said transfer bias change means changes the transfer bias, an adhesion amount of developer mix of the visible image formed on the photosensitive member is detected by said developer mix adhesion amount sensor, and at least one of a charging voltage for charging the photosensitive member and a developing bias for developing the image on the photosensitive member with the developer mix is set on the basis of a deviation between the detected value and a predetermined developing reference value.

5. An apparatus according to claim 2, wherein before said transfer bias change means changes the transfer bias, an adhesion amount of developer mix of the visible image formed on the photosensitive member is detected by said developer mix adhesion amount sensor, and at least one of a charging voltage for charging the photosensitive member and a developing bias for developing the image on the photosensitive member with the developer mix is set on the basis of a deviation between the detected value and a predetermined developing reference value.

6. An apparatus according to claim 3, wherein before said transfer bias change means changes the transfer bias, an adhesion amount of developer mix of the visible image formed on the photosensitive member is detected by said developer mix adhesion amount sensor, and at least one of a charging voltage for charging the photosensitive member and a developing bias for developing the image on the photosensitive member with the developer mix is set on the basis of a deviation between the detected value and a predetermined developing reference value.

7. An apparatus according to claim 1, wherein said transfer means includes a transfer roller, and said developer mix adhesion amount sensor includes an optical sensor.

8. An apparatus according to claim 2, wherein said transfer means includes a transfer roller, and said developer mix adhesion amount sensor includes an optical sensor.

9. An apparatus according to claim 3, wherein said transfer means includes a transfer roller, and said developer mix adhesion amount sensor includes an optical sensor.

10. An apparatus according to claim 4, wherein said transfer means includes a transfer roller, and said developer mix adhesion amount sensor includes an optical sensor.

11. A method for forming an image in an apparatus for forming an image, which has:

a developing unit for forming a visible image on a photosensitive member;

transfer means which is in contact with the photosensitive member and transfers the visible image to a transfer medium;

a developer mix adhesion amount sensor which faces the photosensitive member and detects an adhesion amount of developer mix adhered on the photosensitive member; and transfer bias application means for applying, to the transfer means, a first transfer bias of an opposite polarity to a polarity of the developer mix, and a second transfer bias of the same polarity as the polarity of the developer mix, comprising the steps of:

applying the first transfer bias to the transfer means to transfer the visible image on the photosensitive member to the transfer means;

detecting, by the developer mix adhesion amount sensor, an adhesion amount of residual transfer developer mix which is not transferred and is left on the photosensitive member after the visible image is transferred to the transfer means by the first transfer bias;

changing the first transfer bias on the basis of a deviation between the detected adhesion amount of residual transfer developer mix and a transfer reference value;

applying the second transfer bias to the transfer means to transfer the visible image on the transfer means to the photosensitive member;

detecting, by the developer mix adhesion amount sensor, an adhesion amount of reverse transfer developer mix upon reversely transferring the visible image on the transfer means to the photosensitive member by the second transfer bias; and changing the second transfer bias on the basis of a deviation between the detected adhesion amount of reverse transfer developer mix and a reverse transfer reference value.

12. A method according to claim 11, wherein the step of changing the first transfer bias comprises changing the first transfer bias on the basis of a deviation between the adhesion amount of residual transfer developer mix detected by the developer mix adhesion amount sensor and a predetermined transfer reference value, and the step of changing the second transfer bias comprises changing the second transfer bias on the basis of a deviation between the adhesion amount of reverse transfer developer mix detected by the developer mix adhesion amount sensor and a predetermined reverse transfer reference value.

13. A method according to claim 11, wherein the step of changing the first transfer bias comprises setting in advance a count for correcting the first transfer bias until a deviation between the adhesion amount of residual transfer developer mix detected by the developer mix adhesion amount sensor and a predetermined transfer reference value falls within a first allowable value range, and when the deviation does not fall within the first allowable value range even after the first transfer bias is corrected by the count, changing the first transfer bias to a final correction value, and the step of changing the second transfer bias comprises setting in advance a count for correcting the second transfer bias until a deviation between the adhesion amount of reverse transfer developer mix detected by the developer mix adhesion amount sensor and a predetermined reverse transfer reference value falls within a second allowable value range, and when the deviation does not fall within the second allowable value range even after the second transfer bias is corrected by the count, changing the second transfer bias to a final correction value.

14. A method according to claim 11, further comprising the step of, before the first and second transfer biases are changed, detecting, by the developer mix adhesion amount sensor, an adhesion amount of developer mix of the visible image formed on the photosensitive member, and setting at least one of a charging voltage for charging the photosensitive member and a developing bias for developing the image on the photosensitive member with the developer mix on the basis of a deviation between the detected value and a predetermined developing reference value.

15. A method according to claim 12, further comprising the step of, before the first and second transfer biases are changed, detecting, by the developer mix adhesion amount sensor, an adhesion amount of developer mix of the visible image formed on the photosensitive member, and setting at least one of a charging voltage for charging the photosensitive member and a developing bias for developing the image on the photosensitive member with the developer mix on the basis of a deviation between the detected value and a predetermined developing reference value.

16. A method according to claim 13, further comprising the step of, before the first and second transfer biases are changed, detecting, by the developer mix adhesion amount sensor, an adhesion amount of developer mix of the visible image formed on the photosensitive member, and setting at least one of a charging voltage for charging the photosensitive member and a developing bias for developing the image on the photosensitive member with the developer mix on the basis of a deviation between the detected value and a predetermined developing reference value.

* * * * *